United States Patent [19]

Menet et al.

[11] Patent Number: 5,025,194

[45] Date of Patent: Jun. 18, 1991

[54] VAPOR AND ION SOURCE

[75] Inventors: Jacques Menet, Saint-Egreve; Olivier de Gabrielli, Grenoble, both of France

[73] Assignee: Centre National de la Recherche Scientifique, Paris, France

[21] Appl. No.: 442,798

[22] Filed: Nov. 30, 1988

[30] Foreign Application Priority Data

Nov. 30, 1988 [FR] France ..... 88 16012

[51] Int. Cl.[5] ..... H01J 27/02

[52] U.S. Cl. ..... 315/111.81; 315/111.21; 315/111.41; 313/231.31; 250/423 R

[58] Field of Search ..... 315/111.21, 111.41, 315/111.81; 313/231.31; 250/423 R, 423 F, 425

[56] References Cited

U.S. PATENT DOCUMENTS

| | | | |
|---|---|---|---|
| 2,977,495 | 3/1961 | Klein | 250/425 X |
| 3,223,885 | 12/1965 | Stauffer | 315/111.81 |
| 3,411,035 | 11/1968 | Necker et al. | 315/111.81 |
| 3,414,702 | 12/1968 | Stauffer | 315/111.81 X |
| 4,780,642 | 10/1988 | Jacquot | 315/111.81 X |
| 4,886,992 | 12/1989 | Menet et al. | 313/153 |

FOREIGN PATENT DOCUMENTS 0282467 9/1988 European Pat. Off. .

OTHER PUBLICATIONS

V. A. Saenko et al., "Metal-Ion Source with Hot Hollow Cathode," Instruments and Experimental Techniques, vol. 30, No. 1, part 2, Jan.-Feb. 1987, pp. 168-170, Plenum Publishing Corp., New York.

V. A. Saenko et al., "Plasma Evaporator" Instruments and Experimental Techniques, vol. 26, No. 4, part 2, Jul.-Aug. 1983, pp. 926-928, Plenum Publishing Corp., New York.

M. Mingxtu et al., "A Hollow Cold Cathode Multipurpose Ion Source," Nuclear Instruments and Methods in Physics Research/Section B, vol. B21, Nos. 2-4, Mar. 22, 1987, pp. 182-185, North-Holland Publishing Amsterdam.

J. H. Freeman et al., "The Technology and Chemistry of Heavy Ion Sources," Nuclear Instruments and Methods, vol. 107, No. 3, Mar. 15, 1973, pp. 477-492, North-Holland Publishing Co., Amsterdam.

*Primary Examiner*—Eugene R. LaRoche
*Assistant Examiner*—Do Hyun Yoo
*Attorney, Agent, or Firm*—Lowe, Price, LeBlanc and Becker

[57] ABSTRACT

A vapor and ion source includes, in a low pressure chamber, an anode (M), a cathode (K) and a device (A) for applying a magnetic field (B). The cathode (K) is an equipotential cavity (10) provided with an aperture (11) in a front plate. A magnetic field (B) orthogonal to the front plate is applied thereto. The material to be ionized (15) is arranged inside the cavity.

7 Claims, 1 Drawing Sheet

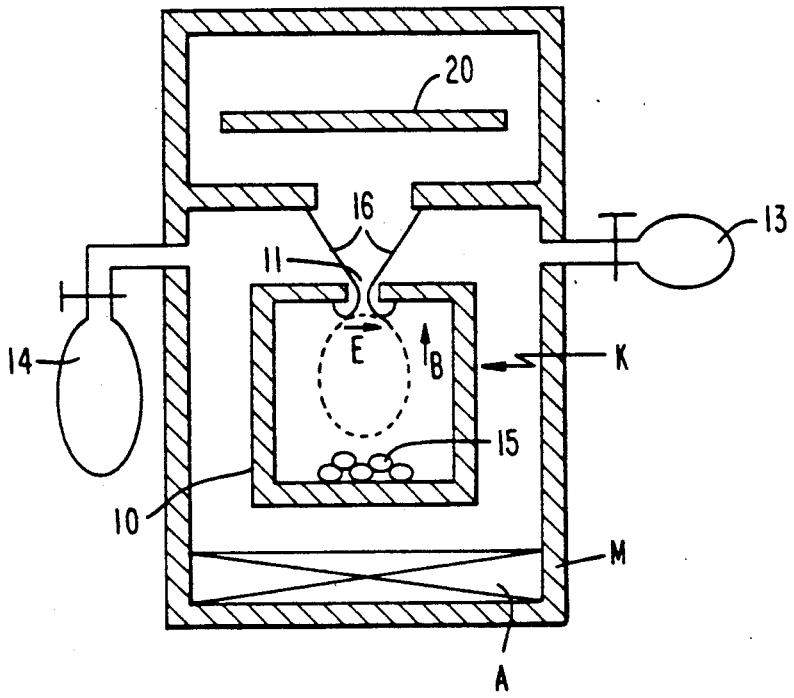
20
16
13
11
14
E
B
K
15
10
M
A

VAPOR AND ION SOURCE

BACKGROUND OF THE INVENTION

The present invention relates to a vapor and ion source, and in particular to a metal vapor and ion source.

In the art, the metal vapor and ion sources conventionally use the bombardment of a target by an electron beam. Complex and fragile prior art apparatuses operate under a high vacuum (in the range of $10^{-3}$ pascals) and have a limited lifetime.

Accordingly, an object of the invention is to provide for another type of vapor and ion source having a very simple structure and a long lifetime.

SUMMARY OF THE INVENTION

For attaining this object, the invention provides for a vapor and ion source comprising, in a low pressure chamber, an anode (ground), a cathode and means for applying a magnetic field. The cathode constitutes an equipotential cavity provided with an aperture in a front plate. A magnetic field is applied orthogonally to the plane of said front plate. The material to be ionized is arranged inside the cathode cavity.

For operating this ion source, a low pressure carrier gas is initially introduced into the chamber and in particular in the cathode cavity, and the cathode is connected to a negative potential in the range of some hundreds volts with respect to the anode (the ground). Such operation causes ionization of the carrier gas and heading of the cathode. Then, the material to be ionized, arranged in the cathode, is vaporized and ionized. The vapors and the ions of the material are then projected towards a target at a negative potential with respect to the plasma potential. Once the phenomenon has started, a pumping can be provided to reduce the quantity of carrier gas which is then unnecessary.

BRIEF DESCRIPTION OF THE DRAWINGS

These and others, objects, features and advantages of the invention will be explained in greater detail in the following description of a preferred embodiment in connection with the attached FIGURE.

DETAILED DESCRIPTION OF THE INVENTION

As shown in the FIGURE, a source according to the invention comprises a cathode 10 provided with an internal cavity and an output aperture 11 arranged in a front plate of the cavity wall. This cathode is enclosed in a chamber, for example a conductive chamber M connected to the ground that will be called hereinafter either the ground or the anode as this chamber constitutes an anode with respect to the cathode 10. This chamber is provided with pumping means 13 and means 14 for introducing a gas, for example helium, argon, etc.

A magnet A or another means for applying a magnetic field applies a magnetic field B at the aperture 11 of the cathode orthogonally to the plane of the front plate thereof. In the cavity 10 is arranged a material to be ionized, for example a metal 15 having the form of a powder, rods, chips, etc.

Initially, the chamber M is evacuated and a carrier gas having a pressure in the range of some tenths to some tens pascals is introduced. When the cathode is at a negative potential in the range of some hundreds volts, an electric field appears and, due to the existence of the cavity, electric field lines 16 curved towards the inside of the cavity appear at the level of the aperture in the front plate, as shown in the FIGURE. Thus, there are areas wherein the electric field E, due to the curvature of the electric field lines, is perpendicular to the applied magnetic field B. Accordingly, a plasma is created at very low gas pressures, lower than in case such crossed electric and magnetic fields do not exit. In fact, it is the edge effect (curvature of the electric field due to the presence of the aperture in the front plate of the cavity) associated with the crossed magnetic field at some places that are at the origin of the plasma creation. Thus, at pressures of the carrier gas higher than some tenths of pascals, a plasma region appears substantially as shown by dotted lines in the FIGURE, at the neighborhood of aperture 11.

This plasma causes heating of the cavity walls 10 and therefore of the material 15 which is vaporized (directly or through a liquefaction). Thus, vapors of the material are created. Those vapors exist through the aperture 11 of the cavity and a substantial proportion thereof is ionized by the plasma electrons so ions of the material 15 are created and can be collected by a plate 20 arranged in front of the cavity aperture, at a negative potential with respect to the ground. This plate therefore receives ions and vapors of the material while the electrons are pushed back by the negative potential towards the ground.

It will be appreciated that the plasma potential is not the potential of the cathode 10, but that, if the potential of the cathode is for example −500 volts, the plasma potential will be of some tens volts. Thus, according to the impact energy that is to be given to the ions on the plate 20, this one will be at a potential varying between about one hundred and one thousand volts.

If the vapor pressure of the material in the cavity increases to a pressure of about one pascal, the introduction of the gas 14 which causes the creation of the plasma can be stopped while continuing pumping by means of the pump 13. The discharge is maintained because, in those conditions, it will be the vapors of material 15 that are substituted for the function of the starting gas. Therefore, a self-sustained plasma exists inside the cavity.

As explained, a self-sustained vapor and ion source is obtained due to the presence of material 15, this source operating under a vacuum of some tenth to some tens pascals.

Material 15 will be for example a metal. In a case in which the cathode is at a potential of −500 volts and plate 20 at a potential of about −1,200 volts, copper was used at about 3 amperes of $Cu^+$ions accelerated under 1,200 volts on a surface of 50 $cm^2$. The deposition speed of the copper atoms on plate 20 were at a rate of 20 micrometers/minute. About 25% of the evaporated copper atoms were ionized.

This possibility of obtaining a self-sustained source due to the presence of a metal, and while being under a vacuum (in the absence of carrier gas) exists for about 60% of the known metals (the ones of which the saturated vapor pressure is higher than some pascals at temperatures lower than 1,600°-1,700° C. which are the temperatures normally occurring inside the cathode cavity).

The method according to the invention presents a large number of advantages over the state of the art, including for example, a high deposition speed in comparison to vacuum sputtering, a high ionization ratio of the metal vapors (up to 25%) while conventional ion deposition methods permit ionization ratios up to 1 to 2%, and the possibility of operating without a carrier gas for 60% of the metals, which reduces the pollution ratio.

In addition the high ion number than can be implanted on a target 20 results in a high adherence of the deposit.

Due to its great simplicity, the device according to the invention can have a long lifetime. Additionally, there is no practical limitation to the size of the device and it is possible to provide bombardment of target 20 on a large length if aperture 12 is an elongated slot.

The invention is capable of numerous variations. The metal constituting the cathode and the ground chamber is chosen from elements that do not react at the operating temperatures, for example tungsten. The chamber can have various shapes and can be associated with a ground grid arranged in front of aperture 11 for improving the starting of the plasma. Various grids and aperture systems at various potentials can be provided in order to accelerate or focus the ions towards the target.

We claim:

1. In a low pressure chamber, a vapor and ion source comprising:

an anode;

an equipotential cavity cathode structure, said cathode structure including a front plate facing said anode, said front plate provided with an aperture;

means for introducing a gas into said chamber;

means for removing gas from said chamber;

ionizable material contained within said cathode cavity;

means for applying a magnetic field perpendicular to said front plate within said cathode cavity; and means for generating an electrical field orthogonal to said magnetic field with said cathode cavity, whereby ion discharge is initiated within said cathode cavity.

2. An ion source according to claim 1 wherein the material to be ionized is a metal.

3. An ion source according to claim 1 wherein the chamber pressure is in a range less than one pascal, this pressure being initially provided by a carrier gas and then by the material to be ionized itself.

4. An ion source according to claim 1 wherein the cathode is at a negative potential greater than one hundred volts.

5. An ion source according to claim 1 wherein said aperture is an elongated slot.

6. A vapor and ion source as recited in claim 1 wherein said aperture is of a length sufficient to permit said electric field to penetrate through said aperture into said cathode cavity to form a plasma in the absence of applied heating means.

7. In a low pressure chamber comprising an anode, an equipotential cavity cathode structure including a front plate facing said anode, said front plate provided with an elongated aperture, and ionizable material contained within the cathode cavity, a method of creating a source of ions comprising:

introducing a gas into said chamber;

applying a magnetic field perpendicular to said front plate within said cathode cavity;

generating an electrical field orthogonal to said magnetic field within said cathode cavity in the absence of external heating to initiate ion discharge within said cathode cavity; and removing gas from said chamber.

* * * * *

UNITED STATES PATENT AND TRADEMARK OFFICE

CERTIFICATE OF CORRECTION

PATENT NO. : 5,025,194

DATED : June 18, 1991

INVENTOR(S) : Jacques MENET et al.

It is certified that error appears in the above-identified patent and that said Letters Patent is hereby corrected as shown below:

On the title page, after [21] Appl. No., change "442,798" to --442,796--.

Signed and Sealed this

Fourth Day of May, 1993

Attest:

Michael K. Kirk

MICHAEL K. KIRK

Attesting Officer

*Acting Commissioner of Patents and Trademarks*

UNITED STATES PATENT AND TRADEMARK OFFICE

CERTIFICATE OF CORRECTION

PATENT NO. : 5,025,194

DATED : June 18, 1991

INVENTOR(S) : Jacques MENET et al.

It is certified that error appears in the above-indentified patent and that said Letters Patent is hereby corrected as shown below:

On the title page, item [22] should read as follows:

--[22] Filed: Nov. 29, 1989--

Signed and Sealed this

Twenty-fifth Day of July, 1995

*Attest:*

*Attesting Officer*

Bruce Lehman

BRUCE LEHMAN

*Commissioner of Patents and Trademarks*